US011331705B2

(12) United States Patent
Vervaet et al.

(10) Patent No.: US 11,331,705 B2
(45) Date of Patent: May 17, 2022

(54) INDUSTRIAL FACILITY COMPRISING A CONTACTLESS WIPER

(71) Applicant: CENTRE DE RECHERCHES METALLURGIQUES ASBL-CENTRUM VOOR RESEARCH IN DE METALLURGIE VZW, Brussels (BE)

(72) Inventors: Bart Vervaet, Zingem (BE); Hugo Uijtdebroeks, Hasselt (BE); Pepijn Adriaen, Koolkerke (BE); Jurgen Malbrancke, Poperinge (BE)

(73) Assignee: CENTRE DE RECHERCHES MÉTALLURGIQUES ASBL—CENTRUM VOOR RESEARCH IN DE METALLURGIE VZW, Brussels (BE)

( * ) Notice: Subject to any disclaimer, the term of this patent is extended or adjusted under 35 U.S.C. 154(b) by 0 days.

(21) Appl. No.: 16/643,609

(22) PCT Filed: Aug. 29, 2018

(86) PCT No.: PCT/EP2018/073263
§ 371 (c)(1),
(2) Date: Mar. 2, 2020

(87) PCT Pub. No.: WO2019/043073
PCT Pub. Date: Mar. 7, 2019

(65) Prior Publication Data

US 2020/0188976 A1 Jun. 18, 2020

(30) Foreign Application Priority Data

Sep. 4, 2017 (BE) ..... 2017/5614

(51) Int. Cl.
*B21B 45/02* (2006.01)
*B21B 27/10* (2006.01)

(52) U.S. Cl.
CPC ..... *B21B 45/0278* (2013.01); *B21B 45/0281* (2013.01); *B21B 45/0284* (2013.01); *B21B 2027/103* (2013.01)

(58) Field of Classification Search
CPC ... B21B 27/06; B21B 27/10; B21B 2027/103; B21B 45/0218; B21B 45/0233;
(Continued)

(56) References Cited

U.S. PATENT DOCUMENTS 2,849,905 A * 9/1958 Heinz ..... B21B 27/10 72/201
3,994,151 A * 11/1976 Stock ..... B21B 27/10 72/201
(Continued)

FOREIGN PATENT DOCUMENTS

DE 3417697 A1 * 11/1985 ..... B21B 45/02
JP H0241710 A 2/1990
(Continued)

OTHER PUBLICATIONS

Translation; DE 3417697 A1, Jabs et al., Nov. 1985.*
Translation JP06-190409A; Kajiwara et al; Jul. 1994.*

*Primary Examiner* — Edward T Tolan
(74) *Attorney, Agent, or Firm* — Leydig, Voit & Mayer, Ltd.

(57) ABSTRACT

An industrial facility includes: a metal strip in motion; and/or at least one work cylinder; a contactless wiping system of a cooling liquid and/or lubricant jet or stream driven by a surface of the metal strip in motion or the work cylinder, the wiping system including a separating cleat with integrated supply of cooling liquid ending with a nozzle bar to be placed along a width of the metal strip or the cylinder
(Continued)

and separated, during use, by a determined interval with respect to the metal strip or the work cylinder, the nozzle bar being oriented so as to supply a jet in a for of a liquid curtain oriented along a direction that is substantially opposite a scrolling direction of the strip or a rotation direction of the cylinder; and a liquid recovery trough, oriented such that during use, liquid sprayed by the nozzles deflects the jet.

14 Claims, 7 Drawing Sheets

(58) Field of Classification Search
CPC ..... B21B 45/0251; B21B 45/0275; B21B 45/0278; B21B 45/0281; B21B 45/0284; B21B 45/029; B21B 45/0293; B21B 45/0296; C21D 1/667
See application file for complete search history.

(56) References Cited

U.S. PATENT DOCUMENTS 4,272,976 A * 6/1981 Pizzedaz ..... B21B 27/10 72/201
4,400,961 A * 8/1983 Schaming ..... B21B 27/10 72/201
4,691,549 A * 9/1987 Adair ..... B21B 27/10 72/201
4,934,444 A * 6/1990 Frischknecht ..... B21B 27/08 164/480
5,046,347 A 9/1991 Crosato et al.
5,212,975 A * 5/1993 Ginzburg ..... B21B 27/10 239/562
5,628,223 A * 5/1997 Denker ..... B21B 45/0278 72/236
5,737,796 A 4/1998 Sendzimir et al.
6,029,681 A 2/2000 Gaydoul et al.
6,151,943 A * 11/2000 Nihei ..... B21B 13/023 72/241.2
8,281,632 B2 * 10/2012 Uijtdebroeks ..... B21B 27/10 72/201
9,108,235 B2 * 8/2015 Kipping ..... B21B 38/00
10,406,574 B2 * 9/2019 Denker ..... B21B 27/10
2003/0168137 A1 * 9/2003 Chikushi ..... B21B 45/0218 148/648
2006/0060271 A1 * 3/2006 Fujibayashi ..... B21B 45/0218 148/638
2012/0031159 A1 * 2/2012 Seidel ..... B21B 27/10 72/6.2
2015/0217336 A1 8/2015 Seidel
2018/0327914 A1 * 11/2018 Taya ..... C23G 3/026
2019/0247901 A1 * 8/2019 Seidel ..... B21B 45/0281

FOREIGN PATENT DOCUMENTS

JP 06-190409 A * 7/1994 ..... B21B 45/02
WO WO 9711797 A1 4/1997
WO WO 2008149195 A1 12/2008
WO WO 2009156956 A1 12/2009
WO WO 2014023753 A1 2/2014

* cited by examiner

INDUSTRIAL FACILITY COMPRISING A CONTACTLESS WIPER

CROSS-REFERENCE TO PRIOR APPLICATIONS

This application is a U.S. National Phase application under 35 U.S.C. § 371 of International Application No. PCT/EP2018/073263, filed on Aug. 29, 2018, and claims benefit to Belgian Patent Application No. BE 2017/5614, filed on Sep. 4, 2017. The International Application was published in French on Mar. 7, 2019 as WO 2019/043073 under PCT Article 21(2).

FIELD

The present invention relates to a wiper or scraper, and more generally to equipment aiming to remove a liquid from the surface of a roller or of a strip, without mechanical contact with the roller or the strip, for use in the field of hot or cold rolling of metallurgical products, such as steel strips, without the invention being limited to such products or such uses.

The invention also relates to an industrial facility such as a rolling mill comprising a metal strip in motion and/or at least one work cylinder as well as a contactless wiping system as defined above.

BACKGROUND

In the field of hot or cold rolling, it is essential to use a highly effective cooling and lubrication method both for the work rollers and for the treated product, such as a metal strip. In order to obtain good cooling and good lubrication, the evacuation of the cooling liquid, in particular the cooling water, is a crucial element of the method. When the cooling water is not discharged quickly enough from the surface of the product, it is indeed noted that the cooling is less effective. Furthermore, in the presence of excess water on the surface of the product, the lubricant used will not correctly adhere to its surface (this is referred to as "oil plate-out", or precipitation/adhesion of oil on the surface).

FIG. 1 schematically shows the combination of lubrication and cooling by water-oil emulsion in a cold rolling mill cage according to the state of the art, both at the inlet and the outlet of the cage. One can see that the presence of traditional scrapers with contact causes water or emulsion to leak toward the strip or roll gap and this water or emulsion mixes with the lubricant that is sprayed on the strip upstream from the cage and that is driven by the strip, making the lubrication less effective and potentially preventing a correct plate-out.

Document WO 2008/149195 A1 discloses a rolling mill for metal products comprising at least one pair of work rollers and at least one cooling device spraying a plurality of pressurized cooling jets on at least one work roller, the cooling device also comprising at least one scraping jet between the cooling jets and the metal product to be rolled, the scraping jet being oriented in the desired flow direction along a reentrant angle toward the perpendicular to the surface of the work roller. The document also discloses a rolling method using said work roller.

Document U.S. Pat. No. 5,737,796 A discloses a wiping system for removing the liquids such as lubricants and cooling liquids from the surface of a metal strip. The system comprises upper and lower wiping rollers for respectively wiping the upper and lower surfaces of the strip. The wiping rollers each comprise a metal core and a resilient porous coating. The wiping system comprises at least one upper bearing roller for said upper wiping roller and at least one lower bearing roller for said lower wiping roller supplying a support for said wiping rollers, in order to press said wiping rollers against the respective adjacent strip surfaces, which causes the formation of a liquid bead on each surface of said strip at the inlet end of the pinching of the wiping roller, in order to engage the respective wiping rollers in the contact zones at the inlet ends of which the oil beads are formed pressed by said porous roller coatings. A suction assembly is provided in order to eliminate the liquid from each bead.

Document U.S. Pat. No. 5,046,347 relates to a coolant containment apparatus for a rolling mill in which aqueous coolant liquid is sprayed onto the upper and lower work roll surfaces by respective upper and lower spray heads only on the exit side of the mill, comprising an enclosure maintained at sub-atmospheric pressure and surrounding the upper spray head and adjacent upper work roll and backup roll surfaces, upper and lower air dam members extending along the edges of the enclosure above and below the spray head to define narrow air gaps at the roll surfaces, slippers connected to ends of the dam members and in rubbing contact with the rolls to maintain the gap widths constant, and seal members mounted on the roll supports at the ends of the mill and cooperating with the enclosure to confine the enclosure interior. A wiper removes coolant liquid from the upper work roll on the entry side of the mill, while collectors catch and remove coolant spraying through the ends of the roll bite at the exit side of the mill. Air is blown into the roll bite on the exit side to move coolant liquid from the surface of an emerging rolled metal strip into the collectors. Below the mill pass line, a shield protects the rolled metal strip from coolant from the lower spray head.

Document JP H0241710 A discloses a contactless device for ensuring good sealing relative to the cooling liquid on the surface of a rolling mill cylinder. Hydraulic cylinders are mounted on a cobble guard and a sealing material is fixed to a piston of the cylinders. The interval between the peripheral surface of a nip-roll and the end of the sealing material is measured by sensor. The end of the sealing material is positioned by actuating the cylinders with a directional control valve so as to adjust said interval in the correct sealing zone. The sealing is therefore achieved without contact between the sealing material and the peripheral surface of the roller.

SUMMARY

In an embodiment, the present invention provides an industrial facility, comprising: a metal strip in motion; and/or at least one work cylinder; a contactless wiping system of a cooling liquid and/or lubricant jet or stream driven by a surface of the metal strip in motion or the work cylinder, the wiping system comprising a separating cleat with integrated supply of cooling liquid ending with a nozzle bar configured to be placed along a width of the metal strip or the cylinder and separated, during use, by a determined interval with respect to the metal strip or the work cylinder, the nozzle bar being oriented so as to supply a jet comprising a liquid curtain oriented along a direction that is substantially opposite a scrolling direction of the strip or a rotation direction of the cylinder; and a liquid recovery trough, configured such that during use, liquid sprayed by the nozzles deflects the jet or stream of liquid and/or lubricant driven by the strip or by the cylinder in order to form a combined stream of liquid or mixture of liquid and lubricant that moves away from the strip or the roller to fall back into the recovery trough and to allow the removal of the combined stream, practically without any more liquid and/or lubricant being driven by the strip or the cylinder downstream from the wiping system, wherein the interval is between 3 and 10 mm, wherein a flow rate of the liquid sprayed by the nozzles is between 10 and 200 $m^3/h$, and wherein a pressure of the sprayed liquid is between 0.5 and 5 bars

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
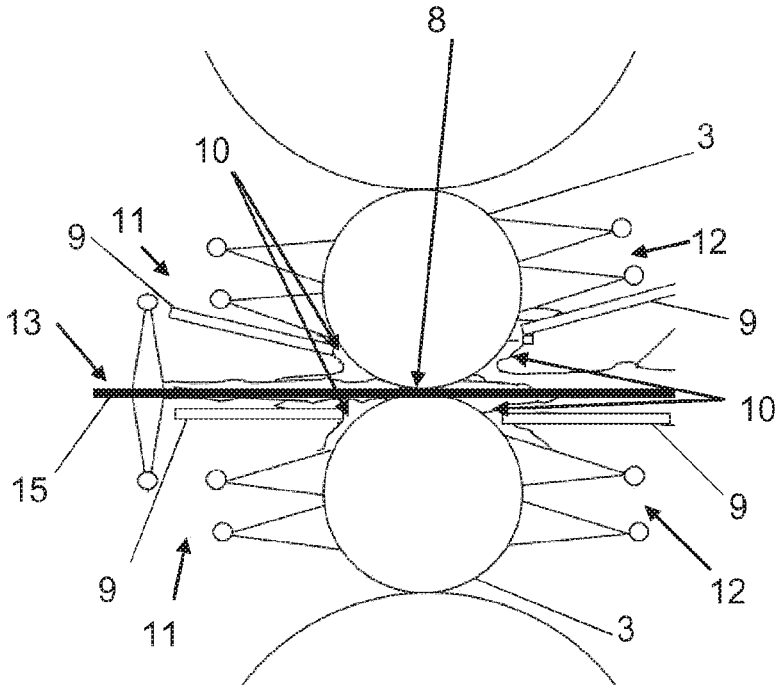
FIG. 1 schematically shows the state of the art for cooling and lubrication in a cold rolling mill cage.

In an embodiment, the present invention provides a contactless wiping solution in hot or cold rolling mills that allows to overcome the drawbacks of the state of the art.

In an embodiment, the present invention provides the ability to control the cooling method in the hot or cold rolling mill without harmful interaction with the lubrication process.

In an embodiment, the present invention provides the ability to increase the effectiveness of early cooling.

A first aspect of the present invention relates to an industrial facility comprising a metal strip in motion and/or at least one work cylinder as well as a contactless wiping system of a cooling liquid and/or lubricant jet or stream driven by the surface of said metal strip in motion or said work cylinder, said wiping system comprising a separating cleat with integrated supply of cooling liquid ending with a nozzle bar intended to be positioned along the width of the metal strip or the cylinder and separated, during use, by a determined interval with respect to the metal strip or the work cylinder, the nozzle bar being oriented so as to supply a jet in the form of a liquid curtain oriented along a direction that is substantially opposite the scrolling direction of the strip or rotation direction of the cylinder as well as a liquid recovery trough, such that during use, the liquid sprayed by the nozzles deflects the jet or stream of liquid and/or lubricant driven by the strip or by the cylinder in order to form a combined stream of liquid or mixture of liquid and lubricant that moves away from the strip or the roller to fall into the recovery trough and to allow the discharge of said combined stream, practically without any more liquid and/or lubricant being driven by the strip or the cylinder downstream from the wiping system, said separating interval being between 3 and 10 mm, the flow rate of said liquid sprayed by the nozzles being between 10 and 200 $m^3/h$ and the pressure of said sprayed liquid being between 0.5 and 5 bars, preferably between 2 and 4 bars.

According to specific embodiments of the invention, the industrial facility with wiping system comprises at least one of the following features, or an appropriate combination of several thereof:

the wiping system is designed to reorient the majority (that is to say, at least 90%) of the liquid or lubricant driven by the strip or cylinder toward the recovery trough, when the residual liquid and/or lubricant is deflected by the liquid sprayed by the nozzles;

the nozzles have an outlet orifice having a diameter of between 1 and 5 mm;

the nozzles are oriented so as to spray liquid on the surface of the strip or work cylinder in a direction forming an angle with said surface of between 0° and 45°;

the flow rate of said liquid sprayed by the nozzles is between 10 and 150 $m^3/h$.

Another aspect of the present invention relates to a rolling mill cage for metal strips comprising at least one pair of work rollers and at least one cooling device spraying a plurality of pressurized jets on at least one of said rollers owing to a plurality of nozzles making up a cooling bar as well as a wiping system as described hereinabove, characterized in that the wiping system is proximal relative to the roll gap of the work rollers and in that the cooling bar is distal relative to said roll gap.

Advantageously, in the aforementioned rolling mill cage for metal strips, the wiping system is located below the height of the axis of the work cylinder.

Also advantageously, in the aforementioned rolling mill cage for metal strips, the wiping system is located at the same level as the height of the axis of the work cylinder.

Still another aspect of the invention relates to a use of the wiping system described hereinabove, characterized in that the liquid sprayed by the nozzles of the wiping system is water or a water-oil emulsion.

Still another aspect of the invention relates to a use of the wiping system described hereinabove, at least partially, for the application of a cooling, preferably a highly-turbulent early cooling.

Still another aspect of the invention relates to a use of the wiping system described hereinabove, as inlet wiper, to prevent a return stream of the inlet cooling liquid, or as outlet wiper, to prevent the cooling liquid from draining off downstream onto the surface of the strip.

Still another aspect of the invention relates to a use of the wiping system described hereinabove, in a hot strip rolling mill, as inlet wiper.

Still another aspect of the invention relates to a use of the wiping system described hereinabove, to eliminate water from a strip surface moving horizontally or vertically in a hot or cold strip rolling mill, for the drying of strips for measuring purposes, for the application of lubricant or for cooling.

Figure 2:
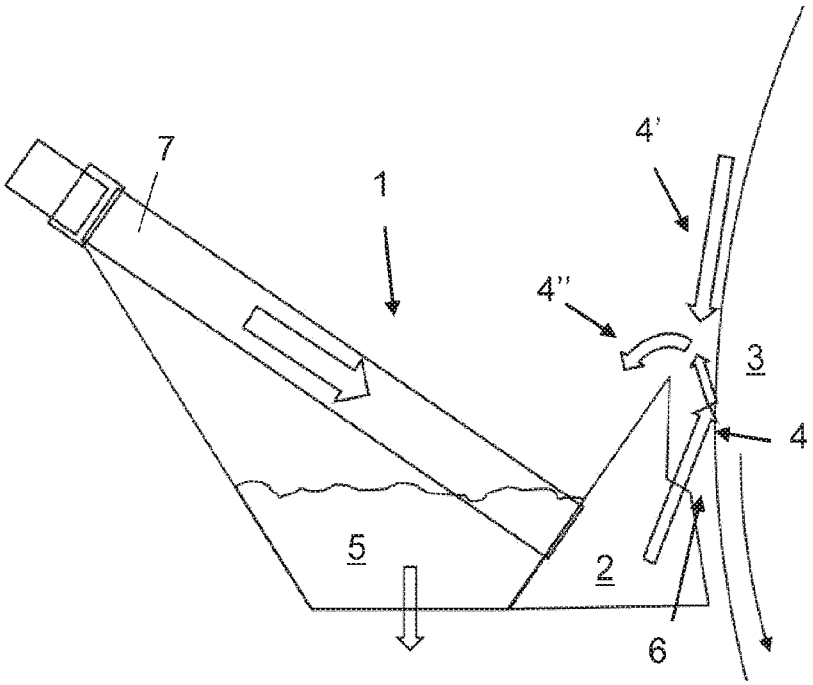
FIG. 2 schematically shows a first embodiment of the wiping system according to the present invention, for use in the case of a work cylinder.

A first embodiment of the wiping or scraping system according to the invention, applicable to a work roller, is shown in FIG. 2.

The body of the wiper 7 supplies the cooling liquid supply and ends with a bar 2 preferably covering the entire width of the cylinder or work roller 3 and provided with a row of removable nozzles. During use, the wiper 1 with its nozzle bar 2 is separated from the work cylinder 3 by a distance or interval 6. According to the invention, the aforementioned nozzles are oriented so as to produce a jet of cooling liquid 4, in practice water or water-oil emulsion, which opposes the jet or stream of water or emulsion 4' applied to the cylinder in the context of the conventional cooling method thereof and which is driven by the latter. The collision of the two opposite jets 4, 4' causes a common radial deflection of the set of the two jets radially toward the outside of the cylinder 3. The deflected common jet 4" is then collected by a trough 5.

Figure 3:
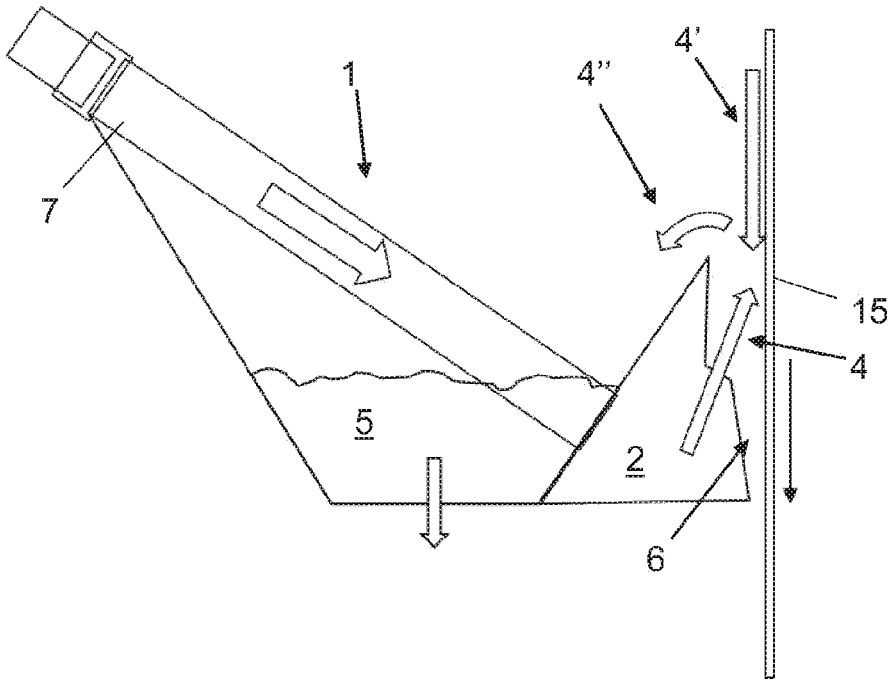
FIG. 3 schematically shows a second embodiment of the scraping system according to the present invention, for use in the case of a metal strip as rolled product.

A second embodiment of the wiping system according to the invention, applicable to a metal strip, is shown in FIG. 3. The device is identical to that of FIG. 2, except for the presence of a planar metal strip 15 in place of the convex surface of the aforementioned work cylinder 3.

The new concept of scraper or wiper with water discharge trough described hereinabove has been successfully developed and tested by the inventors. Even in cases of low flow rates of less than 20 $m^3$/h and low pressures (less than 2 bar), it was possible to prevent the flow of water from the cooling unit of the work rollers toward the roll gap, that is to say, toward the interval between the rollers in contact with the strip.

Figure 6:
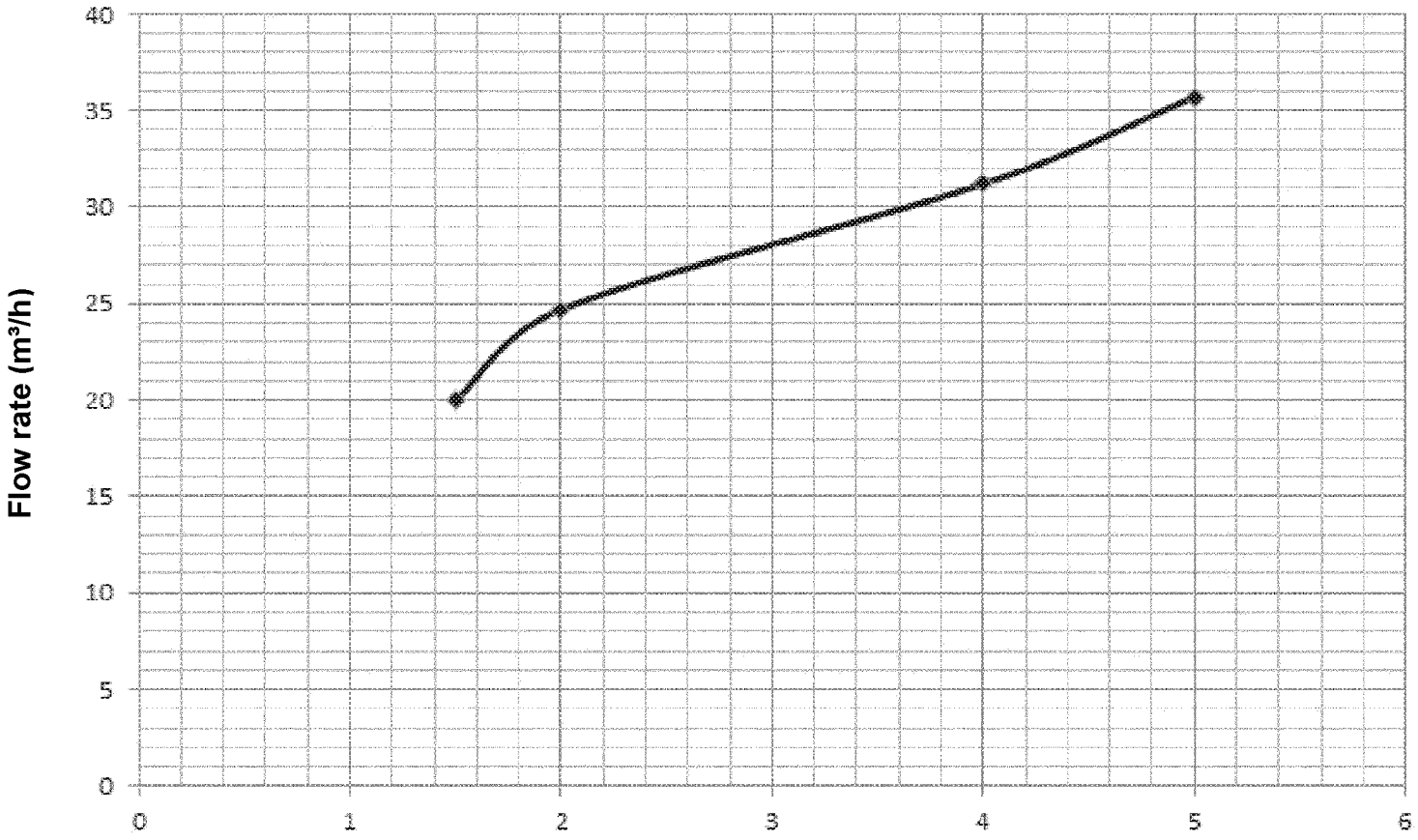
FIG. 6 shows an example flow rate/pressure relationship in the case of a scraping facility according to the present invention.

As an example, FIG. 6 shows a flow rate/pressure curve for a wiper with a length of 1.3 m with nozzle orifices having a diameter of 2.5 mm.

Figure 7:
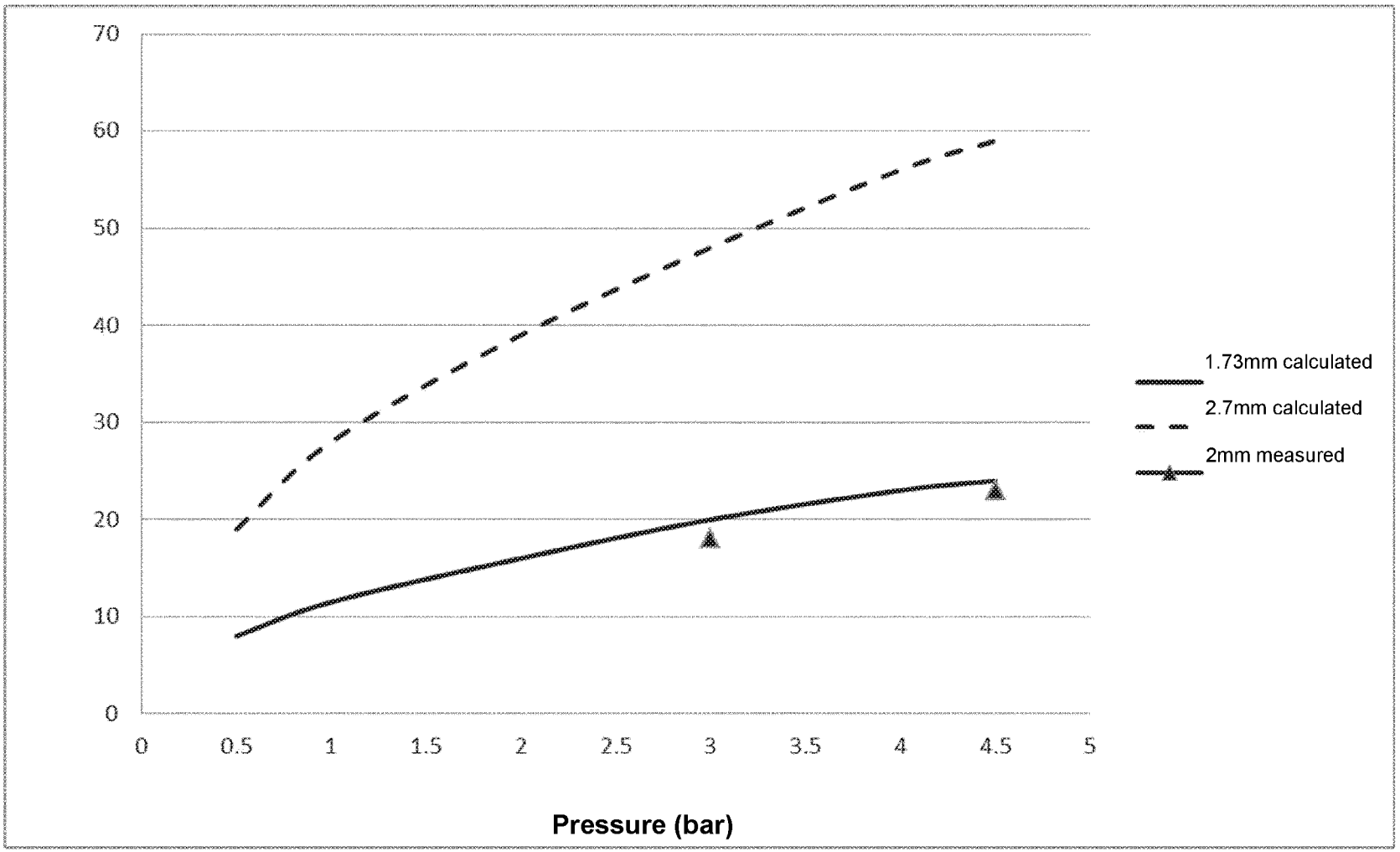
FIG. 7 shows the flow rate/pressure variation in the case of a scraping facility according to the present invention, for different nozzle sizes.

FIG. 7 further shows the flow rate/pressure curve, both calculated (nozzle orifice of about 2 mm and diameter of 3 mm, respectively) and measured (orifice of 2 mm), respectively. At an interval of 5 mm relative to the roller, the 2 mm nozzles provide 90% sealing and the 3 mm nozzles provide nearly perfect sealing of 95-99%. In the present case, the nozzle bar is 1.8 m long.

In addition to procuring sealing, one additional advantage of the water wiper according to the invention is that it allows to implement early and highly turbulent cooling in place of a stationary water bath corresponding to conventional cooling of the work rollers. Early cooling is cooling that is generally achieved between the finishing train and the laminar cooling. It can also be achieved between the roughing train and the finishing train.

Moreover, the water scraper can replace or be combined with the conventional scrapers known in the hot rolling mill. Since the conventional scrapers must come into contact with the work rollers, they wear out or burn with time and cooling liquid leaks may then appear in this location. This can result in a lack of homogeneity of the strip itself or in the temperature and a disturbance in the application of lubricant.

These wipers with contact of the state of the art must therefore periodically be replaced. Since the wiper according to the invention does not touch the work roller, only reduced upkeep is necessary, limited only to the used replaceable water jet nozzles.

In conclusion, the tests performed by the inventors with the wiping system according to the invention allowed to observe the following effects:

total sealing achieved;

early highly turbulent cooling of the work roller achieved (no stagnant water at wiper height);

replacement of the cobble guard in the cold strip rolling mill and use with the cooling of conventional rollers (with flexible cooling);

the discharge trough is indispensable and essential to the invention;

a limited flow rate of about 30 $m^3$/h is necessary for the proper working of the device according to the invention (at low pressures and low flow rates) for a nozzle orifice of 2.5 mm. Beyond 2.5 mm, the water flow rate must be increased;

the device according to the invention is probably adaptable to more conventional industrial configurations of roller cooling (for example with dynamic roller).

The equipment according to the invention can advantageously be used in the cases below.

Figure 4A:
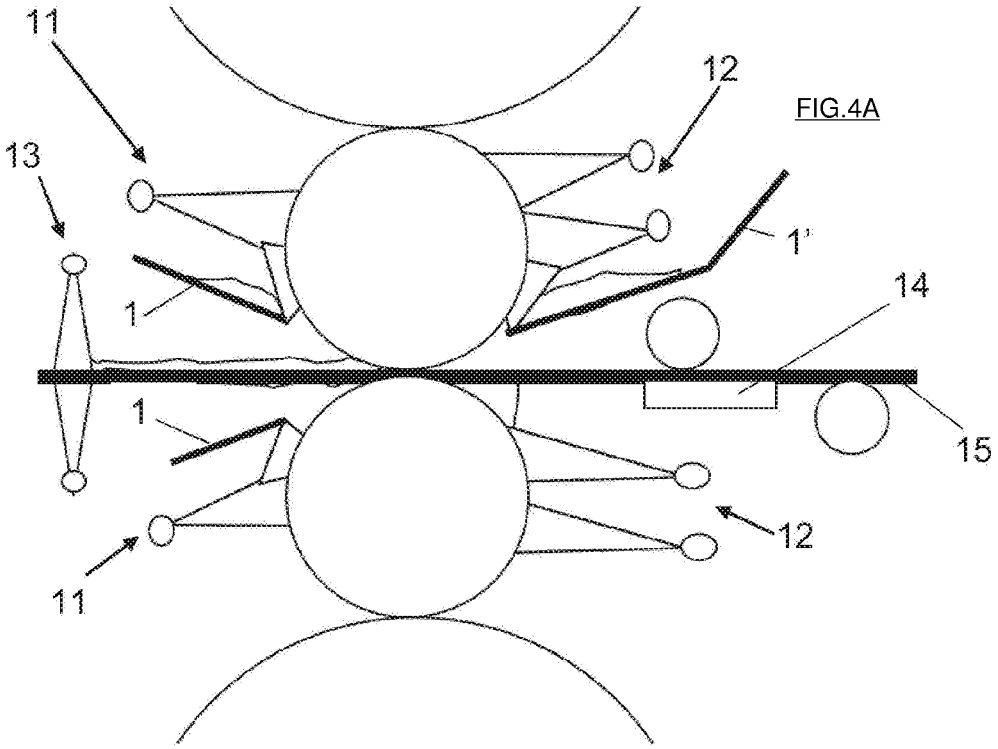
FIGS. 4A and 4B schematically show two embodiments of a wiping facility according to the present invention in the case of the cooling and lubrication in a cage for cold rolling of a metal strip.
Figure 4B:
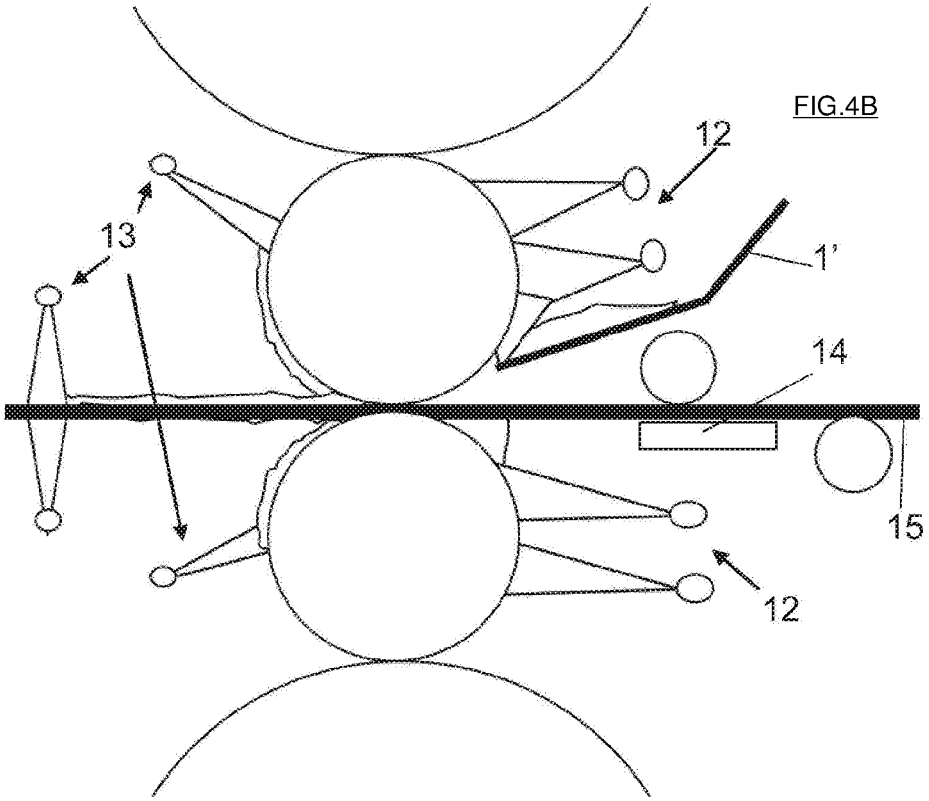

According to a first advantageous embodiment, the invention applies to the cooling of work cylinders in a cold strip rolling mill:

either as inlet scraper 1 (see FIG. 4A), which allows to avoid the return stream of the inlet cooling 11, which noticeably disrupts the lubrication of the strip 13 upstream;

or as outlet scraper 1' (see FIG. 4A and FIG. 4B), which allows to prevent the cooling liquid from draining out onto the surface of the strip 15, thus causing uncontrolled cleaning of the strip. The scraper according to the invention can therefore be combined with selective cooling of the work cylinder. Thus, effective cooling of the work cylinder very far upstream can be obtained.

Figure 5:
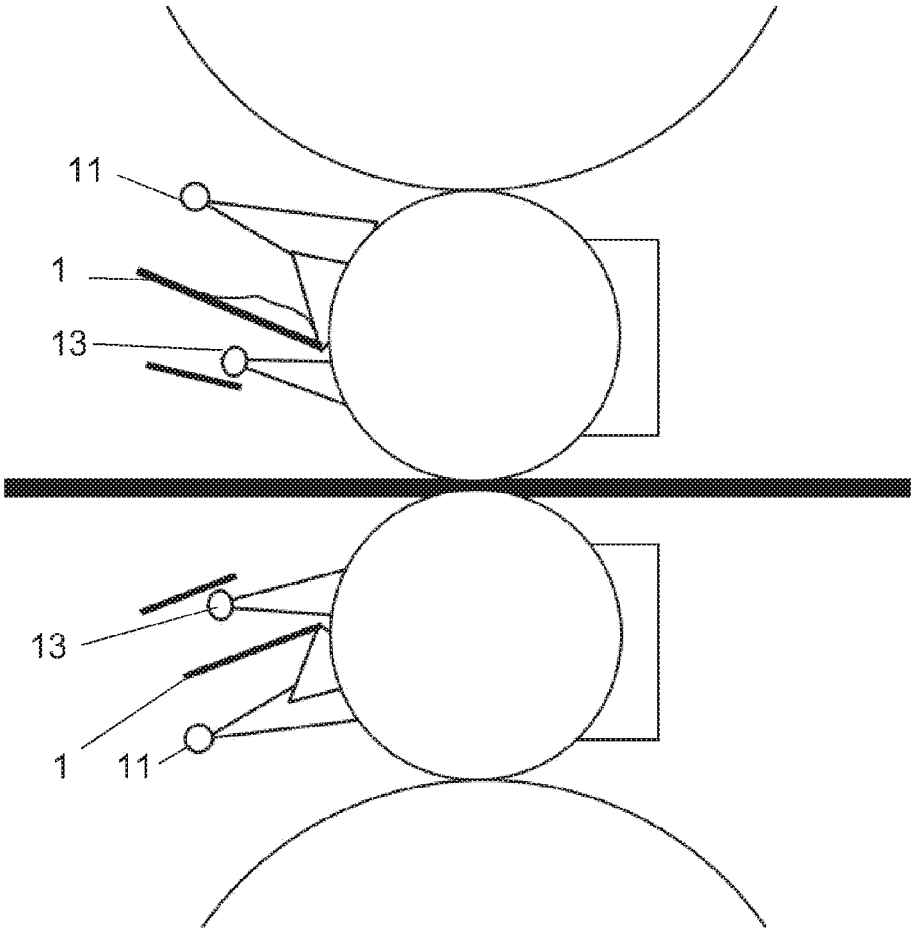
FIG. 5 shows an embodiment of a scraping facility according to the present invention in the case of cooling and lubrication in a cage for hot rolling of a metal strip.

According to a second advantageous embodiment, the invention applies to the cooling of work cylinders in the hot strip rolling mill, as inlet scraper 1 (see FIG. 5). Today, it is impossible to use inlet cooling with effective roll gap lubrication. By using a scraper according to the invention, effective sealing without maintenance can be achieved such that effective lubrication of the roll gap can be achieved. Additionally, since the scraper does not come into contact with the work roller, there will not be any wear of the latter.

According to a third advantageous embodiment, the invention applies to the removal of water from a horizontal or vertical strip surface in the hot or cold strip rolling mill. The aims targeted in this case are for example strip drying for measuring purposes, the application of lubricant or cooling.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1,1'. liquid curtain scraper
2. removable nozzle bar
3. work roll or metal strip (rolled product)
4. liquid curtain sprayed by the wiping system
4'. liquid and/or lubricant driven by the strip or the work cylinder
4". deviated common jet of liquid or liquid/lubricant mixture
5. liquid recovery trough
6. interval between the scraper and the work roll or the metal strip
7. cooling liquid supply
8. roll gap
9. conventional scraper
10. water or emulsion leaks
11. conventional cage inlet cooling by emulsion
12. conventional cage outlet cooling by emulsion
13. convention strip lubrication
14. strip cooling (for example via the "WPC" by the Applicant)
15. metal strip (rolled product)

The invention claimed is:

1. An industrial facility, comprising:

at least one work cylinder, the at least one work cylinder being configured to convey at a surface thereof a first liquid comprising a cooling liquid and/or lubricant jet or stream;

a contactless wiping system comprising a nozzle bar configured to be placed along a width of the work cylinder and separated, in use, by a determined interval with respect to the work cylinder;

a liquid recovery trough; and a rolling mill cage for metal strips comprising at least one pair of work rollers and at least one cooling device spraying a plurality of pressurized jets on at least one of the rollers owing to a plurality of nozzles making up a cooling bar, wherein the at least one pair of work rollers comprises the at least one work cylinder, wherein the nozzle bar is configured so as to supply, in use, a jet comprising a liquid curtain comprising a second liquid that is different from the first liquid in a direction that is substantially opposite a scrolling direction of the strip or a rotation direction of the work cylinder so that the second liquid sprayed by the nozzle bar deflects the jet or stream of the first liquid driven by the strip or by the work cylinder in order to form a combined stream comprising the first liquid and the second liquid that moves away from the strip or the work cylinder to fall back into the liquid recovery trough and to allow the removal of the combined stream so as to minimize the combined stream being further driven by the strip or the work cylinder downstream from the wiping system, wherein the interval is between 3 and 10 mm, wherein a flow rate of the second liquid sprayed by the nozzles of the wiping system is between 10 and 200 $m^3/h$, wherein a pressure of the sprayed second liquid is between 0.5 and 5 bars, wherein the wiping system is proximal relative to a roll gap of the work rollers, and wherein the cooling bar is distal relative to the roll gap.

2. The industrial facility according to claim 1, wherein the industrial facility is configured to reorient a majority of the first liquid driven by the strip or work cylinder toward the recovery trough, when residual first liquid is deflected by the second-liquid sprayed by the nozzles of the wiping system.

3. The industrial facility according to claim 1, wherein the nozzles of the wiping system have an outlet orifice having a diameter of between 1 and 5 mm.

4. The industrial facility according to claim 1, wherein the nozzles of the wiping system are oriented so as to spray the second liquid on the surface of the strip or work cylinder in a direction forming an angle with the surface of between 0° and 45°.

5. The industrial facility according to claim 1, wherein the flow rate of the second liquid sprayed by the nozzles of the wiping system is between 10 and 150 $m^3/h$.

6. The industrial facility according to claim 1, wherein the wiping system is located below a height of an axis of the work cylinder.

7. The industrial facility according to claim 1, wherein the wiping system is located at a same level as a height of an axis of the work cylinder.

8. The industrial facility according to claim 1, wherein the second liquid sprayed by the nozzles of the wiping system comprises water or a water-oil emulsion.

9. The industrial facility according to claim 1, wherein the industrial facility is configured to apply cooling.

10. The industrial facility according to claim 1, wherein the industrial facility comprises a cold strip rolling mill, and wherein the wiping system comprises an inlet wiper, to prevent a return stream of the first liquid, or an outlet wiper, to prevent the first liquid from draining off downstream onto the surface of the strip.

11. The industrial facility according to claim 1, wherein the industrial facility comprises a hot strip rolling mill, and wherein the wiping system comprises an inlet wiper.

12. The industrial facility according to claim 1, wherein the wiping system is configured to remove water from a strip surface in horizontal or vertical motion in a hot or cold strip rolling mill, for drying of strips for measuring purposes, for application of lubricant, or for cooling.

13. The industrial facility according to claim 1, wherein the pressure of the sprayed second liquid is between 2 and 4 bars.

14. The industrial facility according to claim 9, wherein the cooling comprises a highly turbulent early cooling.

* * * * *